United States Patent [19]

Soong

[11] Patent Number: 5,009,422

[45] Date of Patent: Apr. 23, 1991

[54] SPORTS RACKET

[76] Inventor: Tsai C. Soong, 1839 Jackson Rd., Penfield, N.Y. 14625

[21] Appl. No.: 438,862

[22] Filed: Nov. 20, 1989

[51] Int. Cl.[5] ..... A63B 49/02

[52] U.S. Cl. ..... 273/73 D; 273/73 R; 273/73 C

[58] Field of Search ..... 273/73 R, 73 C, 73 D, 273/73 E, 73 H, 73 K, 73 L

[56] References Cited

U.S. PATENT DOCUMENTS

| | | | |
|---|---|---|---|
| 3,078,098 | 2/1963 | Lacoste | 273/73 H |
| 3,206,203 | 9/1965 | Lacoste | 273/73 H |
| 3,968,966 | 7/1976 | D'Aquanni | 273/73 D |
| 4,185,822 | 1/1980 | Li | 273/73 C |
| 4,279,418 | 7/1981 | Lacoste | 273/73 D |

FOREIGN PATENT DOCUMENTS

| | | | |
|---|---|---|---|
| 3018354 | 11/1981 | Fed. Rep. of Germany | 273/73 D |
| 2276845 | 1/1976 | France | 273/73 C |

*Primary Examiner*—Edward M. Coven
*Assistant Examiner*—Raleigh W. Chin
*Attorney, Agent, or Firm*—Bernard A. Chiama

[57] ABSTRACT

A sports racket is disclosed as having an oval-shaped frame supporting a string network. The frame has a generally flat horizontal member arranged in the plane of the network and a generally flat vertical member having a leg extending on both sides of the horizontal member. Openings are formed in the vertical member at both sides of the juncture with the horizontal member for the passage of strings of the network. The outer edge of the horizontal member is rounded for the turn-around of the strings passing through the holes, while the inner edge is tapered so as to avoid contact with the strings.

9 Claims, 3 Drawing Sheets

SPORTS RACKET

BACKGROUND OF THE INVENTION

In the design of frames of sports rackets, there are two principal geometrical directions of particular significance according to ball force and string force directions. One is the plane of the string network where the strings are pulling the frame in toward the center of the network, and the other is the plane perpendicular to it which contains the axis of the center of the cross section of the frame. When the string network contains longitudinal strings and transverse strings which are meshing with each other in a weave pattern, each going over and beneath neighboring strings alternately as is required by the prevailing tennis rules, holes in the plane of the network are invariably drilled through the frame to enable the continuous string remaining in the plane of the network to be able to turn around and change its direction. Prior art includes a design in which a steel wire winding spirally around a frame with strings anchored to its inboard side form a conventional string network wherein the string itself is not winding around the frame per se. However, this is a rare exception wherein strings do not project through holes drilled in the mid-plane of the frame. Due to practical difficulties and inconveniences to do otherwise, all sports rackets, especially tennis rackets, have their strings passing through the holes made in the frame at the mid-plane of the frame.

There are design disadvantages, or difficulties, for having the strings wrapping around the frame for support and then proceeding inboardly to form a string network in the plane of symmetry of the frame section in the conventional sense. Since the impact of the ball load is severe, a typical cross section of the sports frame has greater bending strength in the direction of the ball load than in the plane of the string network. Therefore, the height of the cross section of the frame is greater than its width in most cases, whether the section is solid rectangular, I-beam type or hollow tubular. Such height is ideal for having holes in its neutral axis which will not decrease the section's bending strength and which are in the same plane as the string network. But if the string is to wrap around the height of the cross section, the incoming string and the outgoing string will have a large distance between them. To blend the two strings which are at different levels into an interwoven network in the neutral plane would be very inconvenient or difficult to achieve. Another obvious difficulty is the slipping of the string on the frame when the incoming and exiting strings are not perpendicular to the axis of the frame.

Another disadvantage is related to surface cosmetics damage. With the conventional grommet strip running along the middle of the outer periphery of a frame, strings will not touch the frame. The grommet strip can be imbedded in the middle portion of the wall of the frame which results in a smooth belt. The painted surface of the frame is not touched by the string and a good-looking appearance is preserved. If the incoming and outgoing strings are to wrap aound the outer surface of the wall of the section, a curved grommet strip following the contour of the curved section of the frame has to be used and fixed on the wall. The curved grommet strip should follow the wrapping string and provide a separation between the string and the painted surface of the frame. However, this curved grommet strip would be difficult to manufacture accurately and would seem to be unnecessarily complicated in comparison with the conventional straight grommet strip arrangement.

Still another problem facing designers has been the handling of the incoming and outgoing strings which are at two different levels of elevation, both being displaced from the mid-plane of the frame, and to bring these two levels to the mid-plane of the frame as is required. Because of these problems, the prospect of wrapping strings around the frame instead of drilling through the mid-plane to support the string network has been deemed impractical. In all legitimate design wisdom, the conventional string network which anchors all strings through mid-plane holes in the frame has been adopted as the only choice for many years.

The present invention has been devised to resolve all of the foregoing design problems and proposes a frame design in which the strings are supported by the frame: not by holes made in the mid-plane of the frame, but by having the incoming and outgoing strings wrapped around the outboard part of the frame, both for support and for altering direction. The inventive frame has the advantage of simplicity in design, ease in stringing, ease in manufacture (by the injection molding method), economy in production cost (due to injection molding and elimination of the grommet strip), high cross sectional strength and finally, the most important advantage, the elimination of mid-plane holes that lead to premature frame cracking.

The invention proposes a frame whose cross section is a horizontal bar member joined by a vertical bar member. The horizontal bar member is arranged for the incoming and outgoing strings to be wrapped around and provides high bending strength to resist the string tension in the plane of the string network. Since the string tension acting in the plane of the string network pulls the strings inward toward the center of the network, a wide plate-like horizontal member is very effective for providing the bending rigidity the frame requires. The horizontal member is relatively thin so that the incoming and outgoing strings are not spaced far from the mid-plane. In addition, the weaving of the strings in the mid-plane of the network is made relatively easy. The vertical member of the section is high but narrow and is arranged to provide the bending rigidity for the plane perpendicular to the network plane along the ball force direction. The width of the horizontal member and the height of the vertical member are optimally varied along the axis of the frame so that at the head portion of the racket, where the ball force is small but the string tension force is large, the height of the vertical member is reduced and the width of the horizontal member is wide. The height of the vertical member increases toward the throat of the racket so that the increasing moment of the ball's force is more effectively countered.

Small openings are formed on the part of the vertical member at the junction between the vertical member and the horizontal member so as to let strings pass and wrap around the outboard part of the horizontal member and return toward the interior of the network. Unlike the holes in the conventional frame which are highly stressed due to the pull of the string, the small openings only provide passages and low force contact against slipping for the incoming and outgoing strings to wrap around the outboard part of the horizontal member in forming a network. For strings coming at a sharp angle, the vertical member has enough wall thickness to provide supporting surface to prevent sliding of the string. The contact stress between the string and the wall is a compressive stress which the vertical member can easily withstand. Stringing of the racket is a much simpler task since there is no need for conventional grommet strips with holes in the frame.

DESCRIPTION OF THE PREFERRED EMBODIMENT

Figure 1:
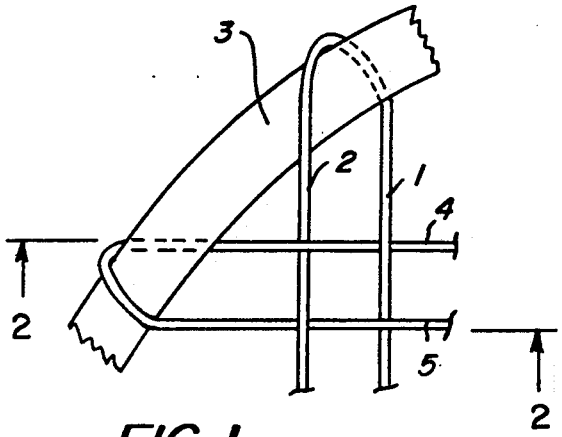
FIG. 1 PRIOR ART
FIG. 1 shows a conventional frame with strings wrapping around the frame.
Figure 2:
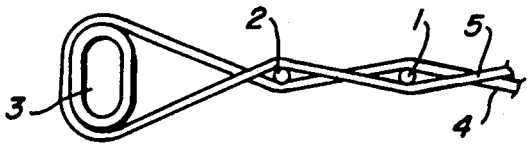
FIG. 2 PRIOR ART
FIG. 2 is a cross sectional view taken along the lines 2—2 in FIG. 1.
Figure 3:
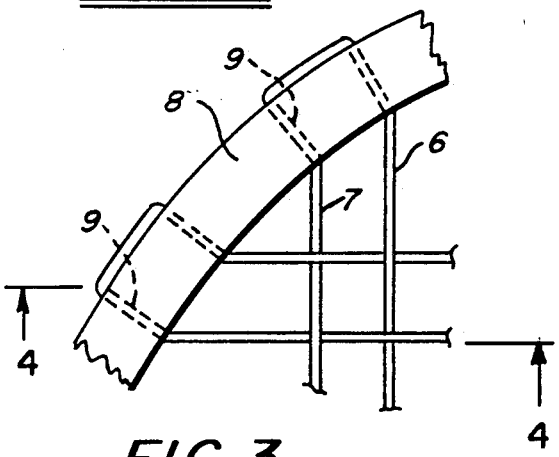
FIG. 3 PRIOR ART
FIG. 3 shows a conventional frame with strings passing through holes in the middle of the frame section in the conventional manner.
Figure 4:
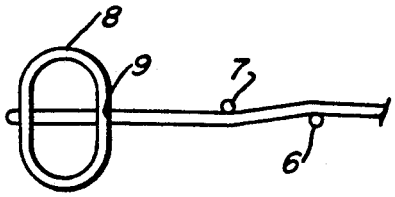
FIG. 4 PRIOR ART
FIG. 4 is a cross sectional view taken along the lines 4—4 in FIG. 3.

FIGS. 1 and 2 illustrate a longitudinal incoming string 1 and an outgoing string 2 wrapping around a conventional tubular frame 3, and an incoming cross string 4 and outgoing string 5 wrapping around the same frame. FIGS. 3 and 4 show the same two strings wrapped around the frame 8 through holes 9 in the mid-plane of the section in the conventional way. It is apparent that there is no device or arrangement to prevent the strings 1 and 2 in FIG. 1 from sliding along the axis of the frame due to the pulling force on the strings. On the other hand, the conventional design, according to FIG. 3, may be useful provided the strings 6 and 7 will not be cut by the wall of the frame, or the wall around the holes 9 will not be crushed by the string force or the stress concentration around the hole is low enough not to cause fracture or propagation of crack lines.

Figure 5:
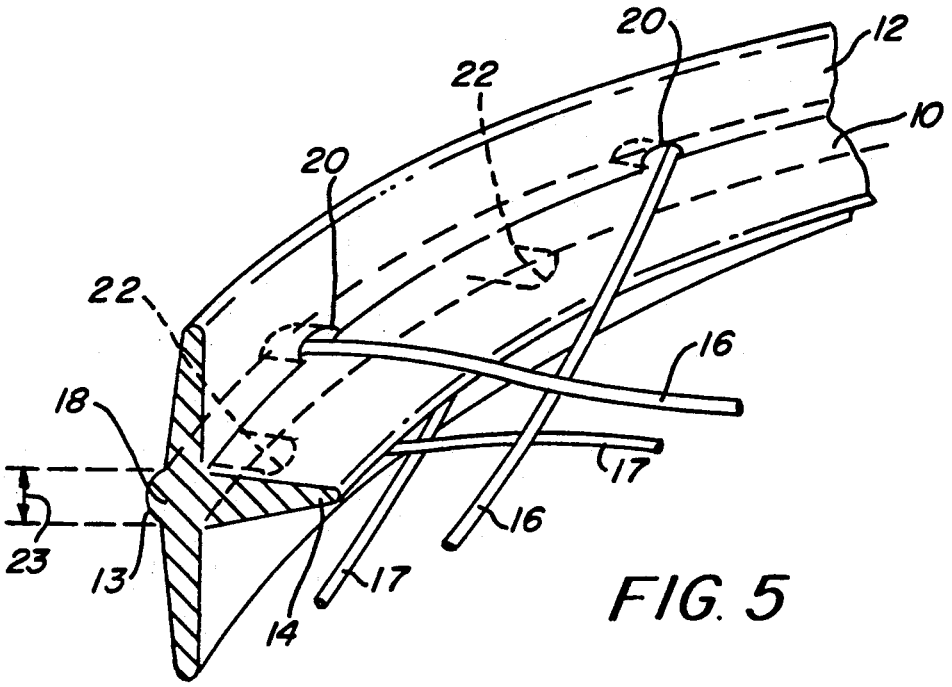
FIG. 5 shows the frame devised in accordance with the present invention with longitudinal and transverse strings wrapped around the frame.

A preferred configuration of the invention is shown in FIG. 5 wherein the cross section of a T-shape frame is composed of a horizontal member 10 and a vertical member 12. A preferred cross section of the horizontal member 10 is round headed at its outboard end 13 and tapers toward its inboard end 14 toward the center of the network. The round head provides a smooth wrap end for a string to wrap around the frame and changes its direction. The tapered end provides adequate clearance for merging of the incoming strings 16 and the outgoing strings 17 which are woven into a flat net at the mid-plane of the frame.

The vertical member 12 is formed at the junction 18 of the two members 10 and 12 with upper level openings 20 so that the incoming strings 16 can enter the outboard end of the horizontal member 12 to wrap around the round headed end 13. Suitable, deep enough grooves (not shown) may be formed along the contact line between a string and the surface of the members to imbed the string inside the groove so that the wall of the groove will prevent slipping.

Since the major force of the string pull is resisted by the wrapping around of the horizontal member, the force component of sliding is small and a deep enough curved groove can be carved from the outboard end of the horizontal leg to provide sufficient resistance. Similar lower level openings 22 are formed at the lower part of the vertical member at the junction line 18 between the vertical member and the horizontal member to let the outgoing string exit to the string network. For application to a tennis racket frame, the frame thickness 23 of the horizontal leg is preferred to be small, 2–7 mm. for example, so that the elevations of the incoming strings 16 and the outgoing strings 17 are not too different, and weaving them into a flat net at the level of the mid-plane of the frame will not be too difficult.

Figure 6:
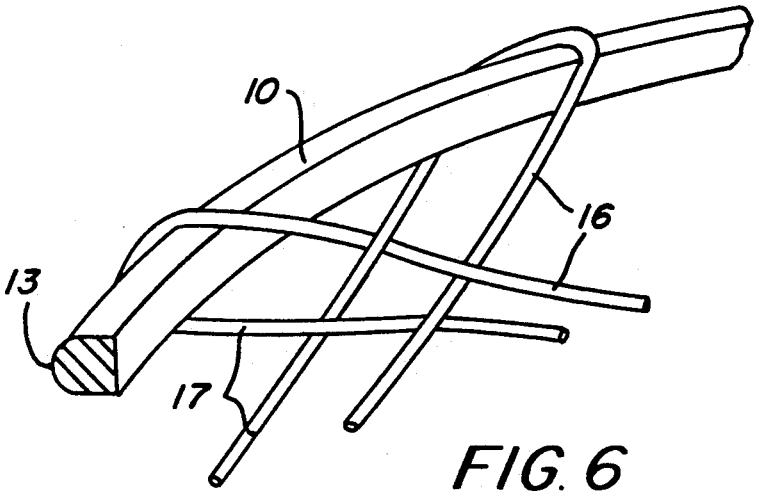
FIG. 6 shows the frame of FIG. 5 with the vertical member removed for clarity.

The T-shape frame in FIG. 5 is shown after the upper and lower parts of the vertical member 12 are removed for clarity is shown in FIG. 6. This clearly illustrates that the string tension force is taken up entirely by the horizontal leg 10. In this manner, the stress concentration at string holes of the conventional frame, which is the primary cause of frame crack, has been avoided. Utilizing the outboard round headed end 13 of the horizontal member to guide and turn around a string and with the entire horizontal member supporting the in-place string force and further, having the sufficiently tall vertical legs of the vertical member 12 to resist the ball's load, this light weight unique frame is an ideal and superior structure for sports rackets rather than rackets cited in prior art which are prone to cracks starting from string holes.

Figure 7:
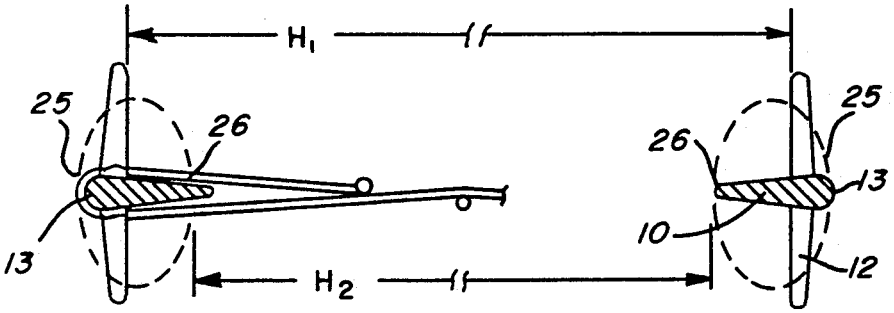
FIG. 7 shows a string entering and leaving the frame at a sharp angle.

Another advantage the present invention provides is the increase of the effective string network area for play. Since the strings are in fact anchored at the round outboard edge 13 of the horizontal member 10 and the remaining inboard part of the member is tapered and consequently is not touched by the string, the length of free vibration of the string in the network is in fact much greater than the conventional racket. As shown in FIG. 7, the larger distance where the width of the network measure on the frame of the present invention between the ends 13 is indicated by H1. The dotted oval 25 is the section of a tubular section of a conventional frame where the measurement of the network begins from the inboard sides of the holes 26 through which strings of the network project. The distance between the inboard sides of the tubular frame 25 is indicated at H2. For a typical tennis racket, H1 minus H2 is approximately one inch (25 mm), and for a conventional mid-size head racket of 9.5 inches (24 cm) width, this 25 mm increase in free vibration length, which is a 10% increase, results in a 21% increase in the effective network area. This is a significant increase in response area and will improve power and playability of the racket manyfold.

The relative size of the horizontal member 10 and the vertical member 12, as shown in FIG. 5, wherein the height of the upper and lower parts of the vertical member is greater than the width of the horizontal member, and the width of the inboard side part of the horizontal member is larger than the width of the outboard side, which yields an increase of effective network area, is the preferred embodiment of the present invention. Other embodiments which could have attractive features of their own are numerous. For example, the width of the outboard side of the horizontal member could be made greater than the width of the inboard side which results in a frame with the vertical member 12 closer to the inboard of the network. This arrangement will yield a racket more compact and agile to play which many players prefer. In addition, the members 10, 12 may be hollow which increases the rigidity of the frame but is at a sacrifice of having more elaborate fabrication processes. The vertical member may be curved and inclined with respect to the horizontal axis and grommet strips may be added for better appearance.

Figure 8:
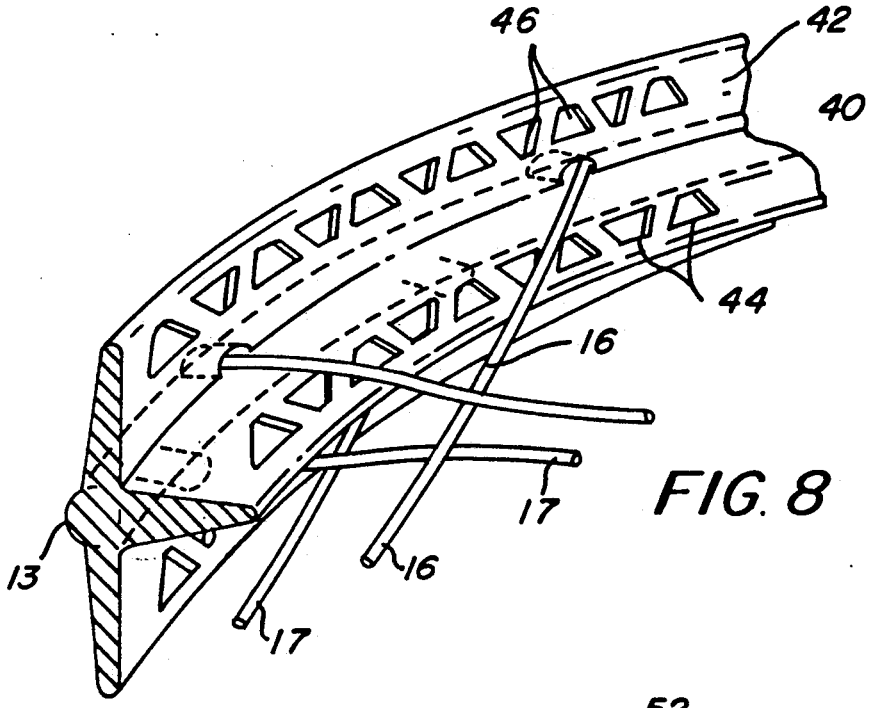
FIG. 8 shows the frame with lightening openings on the vertical and horizontal members to reduce weight and air resistance.

Another embodiment provides an effective way to increase strength and rigidity of a frame structure without increasing its weight. As shown in FIG. 8, the racket frame structure is similar to that in FIG. 5 but has its horizontal member 40 and the vertical member 42 in the form of truss members, with a plurality of openings 44, 46, respectively, to achieve a light weight frame. Since the lightening openings 44, 46 are made far from the string passage openings, strength of the frame is not affected. The members 40, 42 can increase their width and height without adding extra weight and, therefore, are at great advantage from a structural point of view. These lightening openings may be triangular in shape or circular, rectangular, etc., according to classical design of truss frames.

Another advantage of the inventive frame is its low cost and high rate of production. Manufacturing of modern sports rackets uses high strength fiber materials such as graphite, glass fiber, etc., which is time consuming and labor intensive. In conventional manufacturing, a fiber cloth layer with epoxy has to be cut, patched, layered with suitable fiber orientation, rolled into tubular shape around a thermo-expandable core or air tubes, and then carefully inserted into a metal mold. The resultant material is then baked in a high temperature oven, taken out, repaired for imperfections, polished, drilled, painted and stored for grommet strips, handle and stringing. In terms of relative expenditure, it may cost about $18 to $20 to construct a frame and a minimum of three hours of labor to fabricate, whereas the inventive frame needs no core and can be made by the injection process. With a high capacity injection molding press, a frame complete with openings and grooves which requires no further polishing and hand work can be manufactured at a cost of $6 to $7, one frame every 90 seconds, including labor and material costs. The surface of the inventive frame is already smooth and needs very little polishing before painting. If the members are made hollow, though not necessary, molding by short fibers using the meltable core method is available at a slightly higher cost.

Another advantage of the present invention is the simplicity in stringing. For conventional rackets, holes in a grommet strip are only slightly larger than the diameter of the string, and when the string exits from the end of the grommet, it bends sharply if the string meets the axis of the frame at a sharp angle. This adds considerably to the friction force required to pull a string through frame holes. Therefore, for conventional rackets, a string is pulled and clamped once for each hole. For the racket in the present invention, openings in the vertical member and grooves in the horizontal member could be made large, smooth and with generous fillet around the exits in the injection mold. Consequently, friction is small, threading is easy, and a string can be pulled and clamped only once for every two or even three holes without affecting tension accuracy.

Figure 9:
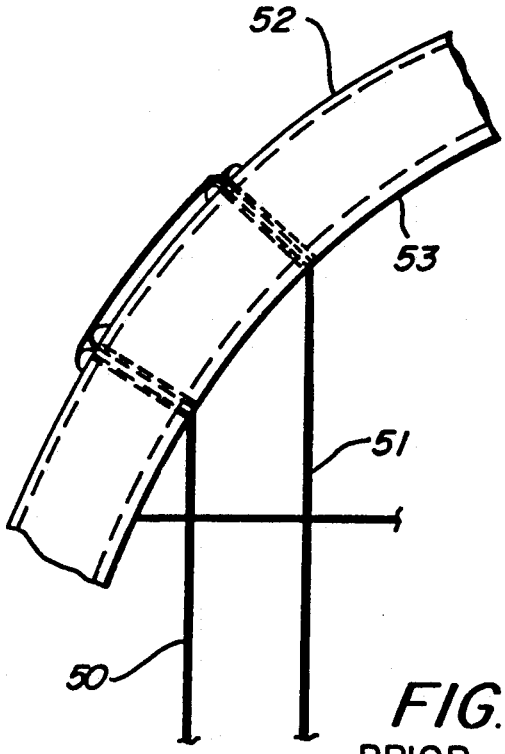
FIG. 9 PRIOR ART
FIG. 9 shows a typical frame with network strings extending therethrough.

A further advantage is frame crack prevention. As mentioned in the foregoing, nearly all cracks of a conventional racket frame start from a string hole, especially from a hole where the string meets the axis of the frame at a sharp angle such as the corner region where the side frame meets the top frame or the throat. FIG. 9 shows outgoing string 50 and incoming string 51, in a typical tennis racket having a frame 52 formed with string holes 53. With a string tension at 27 kg for tennis, the force pressing at the wall of the frame is 28 kg. With a wall thickness of a graphite frame being 1.2 mm and the diameter of the hole being 2.8 mm for a string diameter of 1.26 mm, the bearing area of the wall to sustain the compressive bearing pressure is $0.12 \times 0.28 = 0.034$ $cm^2$ and the intensity of the crushing stress is $28/0.034 = 820$ $ks/cm^2$. This is a stress almost equal to the service stress of the material. For graphite/epoxy material, the suggested service load is not more than 850 $kg/cm^2$. With stress concentration of holes in such applications and repeated vibration load to which the racket will be constantly subjected, crack propagation starting from such holes in the frame is very common. It is the number one structural problem in tennis rackets. Nearly all rackets returned for imperfection claims are due to frame crack started from string holes. The present new frame can completely eliminate this problem. It is to be noted again that the openings in the vertical leg to pass the strings is of an entirely different structural nature, bears very little stress and should not be a source of frame crack.

What is claimed is:

1. In a sports racket having a hand grip joined to a frame supporting a string network extending throughout a ball-hitting region spaced from the grip, the frame having a shank region projecting from the grip and flaring outward in a throat region and surrounding a generally oval ball-hitting region spanned by the string network composed of interconnecting strings, the improvement wherein the frame has a cross section including a first member in the plane of the said string network and a second member arranged approximately perpendicular to the said horizontal member, and whereas the majority of the strings of the string network enter and leave the frame at different levels of elevation away from the said plane of the string network, said strings wrapping said first member for support.

2. The racket as defined according to claim 1 wherein the said majority of strings enter and leave the frame by openings made in the said second member.

3. The racket as defined according to claim 2 wherein the said majority of strings wrap around said first member through holes made solely in the said second member.

4. The racket as defined according to claim 1 wherein the said first and second members contain lightening holes to reduce structural weight and air resistance.

5. The racket as defined according to claim 1 wherein the said second member is curved.

6. The racket as defined according to claim 1 wherein the said second member is hollow.

7. The racket as defined according to claim 1 wherein the frame is made by injection of thermoplastic material reinforced with short fiber graphite or other high strength fibers into forming molds.

8. The racket as defined according to claim 1 wherein grommet strips are used to guide said strings through said members.

9. The racket as defined according to claim 1 wherein the height of the said vertical member is greater than the width of the said first member.

* * * * *